US005207519A

United States Patent [19]

Debreczenyi

[11] Patent Number: 5,207,519

[45] Date of Patent: May 4, 1993

[54] RE-INKABLE METHOD AND ARRANGEMENT FOR PRINTER RIBBONS

[76] Inventor: Frank M. Debreczenyi, 9145 Kopping La., Hickory Hills, Ill. 60457

[21] Appl. No.: 640,641

[22] Filed: Jan. 14, 1991

[51] Int. Cl.[5] ..... B41J 27/12

[52] U.S. Cl. ..... 400/202.4; 283/117

[58] Field of Search ..... 400/197, 202.1, 202.2, 400/202.3, 202.4, 202; 283/114, 117; 366/605; 101/365, 366, DIG. 45, DIG. 47

[56] References Cited

U.S. PATENT DOCUMENTS

| | | | |
|---|---|---|---|
| 2,904,157 | 9/1959 | Smith | 400/202.1 |
| 3,175,780 | 3/1965 | Nettles | 400/202.1 |
| 4,289,413 | 9/1981 | Seplin | 400/202.4 |
| 4,449,838 | 5/1984 | Okamura et al. | 400/202.4 |
| 4,469,457 | 9/1984 | Chida et al. | 400/202.4 |
| 4,653,947 | 3/1987 | Echols | 400/196.1 |
| 4,741,639 | 5/1988 | Fausto et al. | 400/202.4 |

FOREIGN PATENT DOCUMENTS

| | | | |
|---|---|---|---|
| 167892 | 1/1986 | European Pat. Off. | 400/202.4 |
| 2591151 | 6/1987 | France | 400/202.4 |
| 5782 | 1/1981 | Japan | 400/202.4 |
| 118487 | 7/1984 | Japan | 400/202.2 |
| 547815 | 9/1942 | United Kingdom | 400/202.1 |

OTHER PUBLICATIONS

MacInker Brochure.

BMS product information bulletin (Ref. #0-182) entitled: Okidata Microline 182 Fabric Cartridge With Reinker.

Turbon International brochure entitled: Cassette RI--406.00 For Printer F+/C+.

NCR 2140 brochure.

BMS product information bulletin (Ref. #1-206) entitled: "IBM System 32 Model B Harmonica" Fabric Cartridge.

Product-Info Apr. 1985 brochure (Ref. No. S 130) entitled: Shinwa SP 80.

Product-Info Apr. 1987 brochure (Ref. No. C 210) entitled: Centronics 350 IBM 4214.

IBEX II brochure entitled: The Power To Last.

Shennic Industrial Corp. brochure entitled: Shennic Ribbon Inker.

*Primary Examiner*—Edgar S. Burr

*Assistant Examiner*—Stephen R. Funk

*Attorney, Agent, or Firm*—Hill, Steadman & Simpson

[57] ABSTRACT

A method and apparatus is disclosed to manually re-ink cartridge ribbons for printers, word processors, typewriters and the like. By removing a strategic portion of a top cover of the cartridge which overlies the inking pad or roller residing therein, a specific and measured amount of ink can be dropped onto the pad to effectively re-ink the cartridge. A cover having apertures therethrough to install the ink onto the ink pad or roller is provided. A method of apprising the current ink capacity of a cartridge, by comparing the printing output to a printing key is disclosed.

21 Claims, 3 Drawing Sheets

RE-INKABLE METHOD AND ARRANGEMENT FOR PRINTER RIBBONS

BACKGROUND OF THE INVENTION

The present invention relates to printer ribbons and cartridges and an improvement thereof for re-inking the ribbons and cartridges and a method for so re-inking including a system to inform a printer user when re-inking is necessary. The following describes existing technologies for printer ribbons and methods available to users of the ribbons for re-inking.

SPOOLED RIBBONS

These ribbons consist of a band or ribbon of a substrate, usually a woven nylon cloth, saturated with ink, wound on one, or more commonly two, reels or "spools". During the printing operation, the ribbon unwinds and rewinds from spool to spool, reversing direction as it gets toward the end of the ribbon, by means of a switch which is actuated by an eyelet or bar attached to each end of the ribbon, or by means of tension created when the ribbon comes to the end of the spool.

As the ink in the ribbon becomes depleted, the print gets lighter and lighter. At this point, the ribbon is generally discarded, but can be re-inked on a re-inking machine such as the MAC INKER TM automatic ribbon re-inker (patent pending).

The ribbon is removed from the printer and installed in the MAC INKER TM automatic ribbon re-inker to be re-inked. Ink is added to a felt roller which comes into contact with the substrate. The ink is transferred to the substrate by means of capillary action. After adding ink to the roller and installing the ribbon, the machine is turned on and as the ribbon unwinds from one spool and rewinds to the other spool, a small amount of ink is applied to the substrate. When the ribbon is completely unwound/rewound, a switch is actuated which shuts the machine off. Now the user or operator removes the spools from the machine and re-installs them in reverse. Then the machine is turned on again. This process is repeated up to 15 times or more before the ribbon is adequately re-inked.

There are many drawbacks to this process.

The ink in every ribbon has a lubricating effect between the substrate and the printhead which can help to minimize abrasion. When the ink is depleted during use of the ribbon, the substrate soon becomes severely worn or damaged. Re-inking a ribbon in this condition can be difficult. Also, the ribbon could snag or tear in the printer causing loss of printouts, wasted computer time (the report would have to be re-run) and possible damage to the printer or printhead.

It is extremely difficult, if not impossible, to measure how much ink is needed to obtain satisfactory yield and print quality from a ribbon which is re-inked on a MAC INKER TM automatic ribbon re-inker device. If you do not apply a sufficient quantity of ink, the yield will be poor and the ribbon will have to be removed from the printer again and re-inked in the MAC INKER TM automatic ribbon re-inker more frequently. If you apply too much ink to the ribbon, it can cause streaking and smearing on the paper. This is such a common problem, that the manufacturer of the MAC INKER TM automatic ribbon re-inker has included instructions on what to do if this occurs.

This system has no way of accurately measuring inking, is very time consuming and complicated, is prone to error by the user and can be very messy.

CARTRIDGE RIBBON WITH CONTINUOUS LOOP AND INK RESERVOIR

These ribbons come in many styles for different printers, although the basic concept and design is the same for all of them. The basic concept consists of a seamless or welded ribbon loop which is fanfolded or "stuffed" into the cartridge. The ribbon advances by means of a drive gear meshing with an idler gear, with the ribbon sandwiched between them. These internal drive gears which are built into the cartridge are driven by a mechanism in the printer which turns them, pulling the ribbon through the cartridge as it fanfolds at the same time.

The inker reservoir may consist of a felt or foam, roller or pad. The reservoir is in constant contact with the drive gear or idler gear. Ink is transferred from the reservoir to the gear(s) which in turn transfer(s) the ink to the substrate. When the ink in the reservoir is depleted, it cannot be refilled, so the ribbon is usually discarded. Re-inking the substrate or ribbon with an external re-inking device such as the MAC INKER TM automatic ribbon re-inker, without refilling the reservoir, would only extend the life of the ribbon by 2% to 5%.

The ink in the ribbon has a lubricating effect between the substrate and the printhead, which helps to minimize abrasion. Since the length of this type of ribbon is generally very short in comparison to other types of ribbons, when the ink is depleted during initial use, the substrate can become severely worn or damaged very quickly. Re-inking a ribbon in this condition can be difficult. Also, the ribbon could snag or tear in the printer causing loss of printouts, wasted computer time (the report would have to be re-run) and possible damage to the printer or printhead.

CARTRIDGE RIBBON-CONTINUOUS LOOP-WITHOUT INK RESERVOIR WITH INTERNAL DRIVE GEARS OR ROLLERS

This concept or design is similar to the one described directly above except that the substrate or ribbon is generally longer, it is usually a welded loop and it does not have any ink reservoir. Since there is no ink reservoir, the print yield may be less than shorter ribbons with an ink reservoir. When the ink in the ribbon is depleted, the ribbon is usually discarded and replaced.

These ribbons can be re-inked with devices such as the MAC INKER TM automatic ribbon re-inker The ribbon is removed from the printer and installed in a MAC INKER TM automatic ribbon re-inker which has a drive system similar to that in the printer. Ink is added to a felt roller or pad which comes into contact with the substrate. The ink is transferred to the substrate by means of capillary action. After adding ink and installing the ribbon, the machine is turned on and as the ribbon is pulled through and fanfolded into the cartridge a small amount of ink is applied to the substrate by means of contact to the external roller or pad.

There are many drawbacks to this process.

The ink in every ribbon has a lubricating effect between the substrate and the printhead which can help to minimize abrasion. When the ink is depleted during initial use of the ribbon, the substrate soon becomes severely worn or damaged. Re-inking a ribbon in this condition can be difficult. Also, the re-inked ribbon could snag or tear in the printer causing a loss of printouts, wasted computer time (the report would have to be rerun) and possible damage to the printer or printhead.

It is extremely difficult if not impossible, to measure the amount of ink needed to obtain satisfactory yield and print quality from a ribbon which is re-inked on a MAC INKER TM automatic ribbon re-inker device. If you do not apply a sufficient quantity of ink, the yield will be poor and the ribbon will have to be removed from the printer again and re-inked in the MAC INKER TM automatic ribbon re-inker more frequently.

If you apply too much ink to the ribbon, it can cause streaking and smearing on the paper. Over-inking can also cause the drive gears to slip on the ribbon as they turn. As a result, the ribbon will not advance in the printer and will jam causing possible damage to the ribbon, printhead or printer. This is such a common problem that the manufacturer of the MAC INKER TM automatic ribbon re-inker has included instructions on what to do if this occurs.

This system of re-inking provides no method of accurately measuring inking, is very time consuming and complicated, is prone to error by the user and can be very messy.

CARTRIDGE RIBBON-CONTINUOUS LOOP-WITHOUT INK RESERVOIR WITH EXTERNAL DRIVE GEARS OR ROLLERS

This concept or design is similar to the one described directly above except that the gears or rollers which pull the ribbon through and fanfold it into the cartridge are not built into the cartridge but are a part of the printer itself. There is an opening in the cartridge into which the drive gears or rollers fit when the ribbon cartridge is installed in the printer. As with other concepts, there are many different styles and variations of this design, but the basic concept is the same for all of them. When the ink in the ribbon is depleted, the ribbon is usually discarded and replaced.

These ribbons can be re-inked with a device such as the MAC INKER TM automatic ribbon re-inker. The ribbon is removed from the printer and installed in a MAC INKER TM automatic ribbon re-inker which has a drive system similar to that in the printer. Ink is added to a felt roller or pad which comes into contact with the substrate and is transferred by means of capillary action. After adding ink and installing the ribbon, the machine is turned on and as the ribbon is pulled through and fanfolded into the cartridge a small amount of ink is applied to the substrate.

There are many drawbacks to this process.

The ink in every ribbon has a lubricating effect between the substrate and the printhead which can help to minimize abrasion. When the ink is depleted during the initial use of the ribbon, the substrate soon becomes severely worn or damaged. Also, the re-inked ribbon could snag or tear in the printer, causing a loss of printouts, wasted computer time (the report would have to be rerun) and possible damage to the printer or printhead.

It is extremely difficult, if not impossible to measure the amount of ink needed to obtain satisfactory yield and print quality from a ribbon which is re-inked on a MAC INKER TM automatic ribbon re-inker type device. If you do not apply a sufficient quantity of ink, the yield will be poor and the ribbon will have to be removed from the printer again and re-inked in the MAC INKER TM automatic ribbon re-inker more frequently.

If you apply too much ink onto the ribbon, it can cause streaking and smearing on the paper. Over-inking can also cause the drive gears or rollers to slip on the ribbon as they turn. As a result, the ribbon will not advance in the printer and may cause jamming and possible damage to the ribbon, printer or printhead. This is such a common problem that the manufacturer of the MAC INKER TM automatic ribbon re-inker has included instructions on what to do if this occurs.

This system of re-inking provides no method of accurately measuring inking, is very time consuming and complicated, is prone to error by the user and can be very messy.

SUMMARY OF THE INVENTION

The following describes the improvements and advantages of the proposed arrangement for re-inking printer ribbons compared to art currently available to the consumer or user.

PROCESSING TIME, SKILL AND EQUIPMENT REQUIREMENTS

In the prior art the cartridge or ribbon must be removed from the printer and installed in an external re-inking device such as the MAC INKER TM automatic ribbon re-inker. The ribbon is then re-inked, and removed from the device to be re-installed in the printer. Other functions performed by the operator would include adding ink to the MAC INKER TM automatic ribbon re-inker ink roll or pad, visually checking operation of the machine and cleaning of the ribbon in the event that it becomes over-inked during the re-inking process. These processes can take anywhere from 15 minutes to many hours per ribbon depending on the skill or improvisational ability of the operator. In addition, the user must purchase a re-inking device from the company who supplies devices such as the MAC INKER TM automatic ribbon re-inker. These machines can be expensive. The machines take up much needed space in the office or work area. If a user replaces his printer(s), his re-inking machine may not re-ink the ribbons for his new printer(s), therefore making the re-inker obsolete.

The invention eliminates most of the steps and work required for the prior art and also eliminates the cost and space requirements of the re-inking machine. This is accomplished by making changes to the existing ribbon cartridges in a manner which allows the user to add the ink directly into the cartridge without removing it from the printer. The basic concept for the changes is the same regardless of the shape or design of the cartridge.

INK DEPLETION AND LUBRICATING EFFECT BETWEEN PRINTHEAD AND RIBBON SUBSTRATE

The ink in every ribbon has a lubricating effect between the printhead and substrate which minimizes abrasion. In the prior art, as the ink becomes depleted, the lubricating effect is greatly diminished. Most users leave the ribbon in the printer, without re-inking it, until the print becomes relatively light, because of the inconvenience and time required in the prior art. At this point the substrate may become severely worn or damaged. Re-inking the ribbon in this condition is difficult. The re-inked ribbon may snag or tear in the printer, causing a loss of printouts, wasted computer time (the report would have to be rerun) and possible damage to the printer or printhead.

The system of re-inking using the invention prevents the depletion of ink, and therefore prevents the loss of the lubricating effect between the printhead and ribbon substrate.

When the user purchases a ribbon with the new re-inkable arrangement, he is provided with color print density charts or gauges, sample printouts and specific instructions explaining when the ribbon is to be refilled with ink. The user is generally instructed to begin adding ink to the re-inking reservoir on a regular basis after commencing use of the ribbon, in accordance with the recommendations provided.

Since refilling the reservoir with ink is not time consuming, 15–30 seconds for the invention compared to 15 minutes to many hours for the prior art, the user more readily follows the recommendations provided with the ribbon, that the ink in the reservoir shall be topped up on a regular basis and not be allowed to become depleted.

PRINTOUT CONSISTENCY

In the prior art, as the ribbon is used, the print becomes lighter and lighter as the ink is depleted. Users leaving the ribbon on the printer for longer periods of time before re-inking or replacing them due the time requirements, inconvenience and inconsistency of re-inking using the prior art and the high cost of replacement ribbons.

The convenience of the invention enables and motivates the user to refill the reservoir as recommended, on a regular basis, resulting in a more consistent intense or jet black printout (or other color during the full life of the ribbon, as opposed to an intense black (or other color) fading or turning lighter as with the prior art.

RE-INKING ACCURACY

Re-inking accuracy is difficult to achieve with the prior art. The ribbons may often become over-inked or under-inked. If over-inked, the drive gears or rollers could slip on the ribbon and the ribbon will not advance. In a short time the substrate will be damaged and the ribbon will be unusable and must be discarded.

If under-inked, the customer will get a poor yield and will have to re-ink the ribbon more often. Under-inking also diminishes the lubricating effect between the ribbon substrate and the printhead resulting in an increase of abrasion and premature wear or damage to the ribbon substrate.

It is difficult to control re-inking accuracy with the prior art because one cannot see how much ink is being applied to the substrate during the re-inking process. If the operator leaves the ribbon on the re-inker too long it may become over-inked. If the operator removes it from the re-inker too soon it may be underinked. The manufacturer of the re-inker does not provide any specific recommendations as to the "quantity of ink" that should be added to the ribbon during the re-inking process, nor is there any way of measuring the amount of ink added to the ribbon.

Re-inking accuracy with the invention is improved. Specific directions instruct the user on when and how much ink to add to the reservoir based on the following means of measurement:

1. Comparison of print density (blackness) to color charts, gauges or sample printouts supplied with the ribbon with specific directions advising the user at what level of print density ink is to be added to the reservoir.

2. Recommendations advising the user that a specific number of pages of printout can be expected between each refilling of the ink reservoir.

3. Instructions as to a specific amount of ink to be added to the reservoir when refilling. This may either be a specific number of drops or an amount to cover a specific area on top of the reservoir.

Following these recommendations will eliminate the conditions of underinking or overinking and minimize the need for special "skills" or "observational abilities" or guesswork when re-inking, as is required when using devices such as the MAC INKER TM automatic ribbon re-inker.

CONVENIENCE AND CLEANLINESS

The prior art is generally considered to be a messy process because of the excessive amount of handling of ribbons and ink due to the fact that they are repeatedly removed from the printer, installed in the MAC INKER TM automatic ribbon re-inker type re-inking device and then must be re-installed in the printer. Operators can get a lot of ink on their hands by touching the ribbon itself or accidentally touching the re-inking roller or pad on the re-inking device. Ink also may accidentally leak or spill from the bottle, re-inking roller or re-inking pad.

The invention eliminates these problems because the ribbon is never removed from the printer during re-inking or refilling. Ink is added directly to the ribbon's easy fill reservoir which has adequately sized openings to prevent leakage, spillage and overfill. The ink itself is provided in special drip proof bottles or other similar drip proof containers. Over 75% of all "handling" processes are eliminated and as a result the "inky mess" is controlled and minimized.

EXTENDED PRINTER LIFE

An additional benefit of the invention over the prior art is an extended print head life and a reduction of printer failure and maintenance expense. In the prior art, ink depletion occurs and the lubricating effect of the ink between the ribbon substrate and the printhead is diminished. Abrasion on the printhead and printpins is therefore increased and life of the printhead may be shortened.

According to the invention, when applied as directed, the ink is always at an optimal level and hence the lubricating effect is optimal while abrasion is minimized. It can be compared to maintaining optimum levels of oil and lubricants in an automobile.

COST, ENERGY, PETROLEUM AND LANDFILL BENEFITS COMPARED TO PRIOR ART

With the present invention ribbon life is extended by 3 to 10 times and possibly more. The cost savings to the user are obvious. Overall savings to the user could be anywhere from 33% to 80%. The user will also save printer maintenance costs and the expense involved in purchasing re-inking machines such as the MAC INKER TM automatic ribbon re-inker.

Many of the materials used in the manufacture of printer ribbons are petroleum derivatives. These materials include the plastic cartridge components, ink and substrate materials. The concept in my re-inkable arrangement can be applied to most all styles and types of cartridge printer ribbons. If it were applied to the majority of cartridges, many barrels of petroleum could be saved. This would be a contribution to energy conservation and self-sufficiency for our nation.

Cartridge printer ribbons are not bio-degradable. After they are used, they must be dumped in a landfill. If burned, they emit highly toxic gases, so incineration is not recommended. The re-inkable arrangement can reduce the amount of used ribbons going into landfills.

The prior art of re-inking using the MAC INKER TM automatic ribbon re-inker device requires a certain amount of experimentation, self training, experience and improvisational skill before a satisfactory result can be achieved with the method. With the new technology which incorporates the re-inkable arrangement in the cartridge the process has been simplified and the directions provided are clear and complete so that the method will work satisfactorily without a lot of time spent on observations, experimentation, self-training and improvisation.

DETAILED DESCRIPTION OF THE PREFERRED EMBODIMENTS

Figure 1:
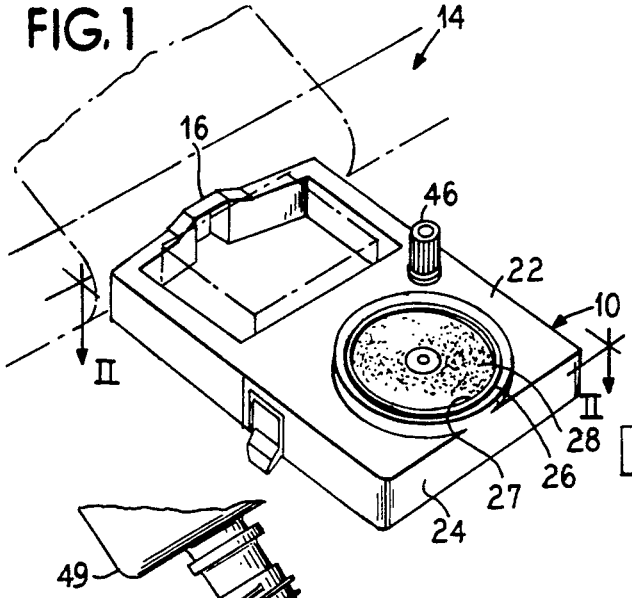
FIG. 1 is a perspective view of a printer ribbon cartridge showing an application of the invention.

FIG. 1 shows generally at 10 a printer cartridge. Many configurations of printer cartridges for computer printers, typewriters, word processors, and the like are currently available, only a few of such cartridges are illustrated herein. The cartridge 10 of FIG. 1 corresponds generally to an Okidata Microline 182 fabric cartridge with re-inker but modified by the present invention. The cartridge 10 is engaged to a printer 14 as is known in the art. The cartridge 10 provides a head portion 16 for interaction with the printing mechanism and the paper. However, according to the present invention cartridge 10 provides a top cover 22 and sidewalls 24 as well as a bottom plate 25 (shown in FIG. 3). An annular lip 26 is mounted onto the cover 22 and circumscribes an opening 27. This opening 27 is an important attribute of the present invention and will be described hereinafter.

Figure 2:
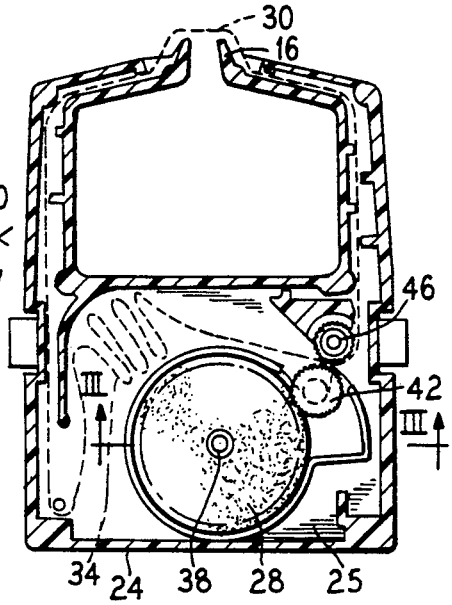
FIG. 2 is a sectional view taken generally along line II—II of FIG. 1.

FIG. 2 shows a ribbon 30 extending throughout the cartridge 10 in a continuous loop. Excess ribbon 30 is fan folded into a space 34 inside the cartridge 10. In the preferred embodiment the ribbon 30, commonly a woven nylon cloth ribbon as known in the industry, would be 3 mil, 4 mil, or 5 mil in thickness with a thread count of 280 or more, or a high density nylon with a thickness of 5–5.2 mil on a thread count of 300 or more. The ribbon 30 is pinched between a drive roller 46 and a idler roller 42. The idler roller 42 presses against an ink pad such as an ink roller 28 rotatably mounted on a spindle 38. The ink roller 28 is located directly beneath the opening 27. The ink roller 28 is made of an absorbent type material such as a foam or felt material which can absorb and hold ink therein. The idler roller 42 constantly removes some ink from the ink roller 28 and deposits the ink onto the ribbon 30 as it passes between the drive roller 46 and the idler roller 42.

Figure 3:
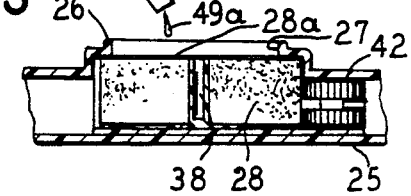
FIG. 3 is a partial sectional view taken generally along line III—III of FIG. 2.

FIG. 3 shows an inventive method of re-inking the ink roller 28. A spill resistent, drip resistent ink bottle 49 is used to manually drop a measured amount of ink **49*a* onto a top 28*a* of the ink roller 28. The ink bottle 49 can be a drip-proof squeeze bottle or a dropper bottle which utilizes an "eye dropper" type delivery device having a squeeze bulb at one end of a open ended tube. A plunger-syringe type device can also be used. Periodic replenishing of the ink by this manual means can prolong the useful life of a cartridge dramatically. The lip 26 prevents overfilling and spillage out of the opening 27 and the lip overlies the ink roller 28 to prevent extraction of the roller 28 out of the opening 27**.

Figure 4:
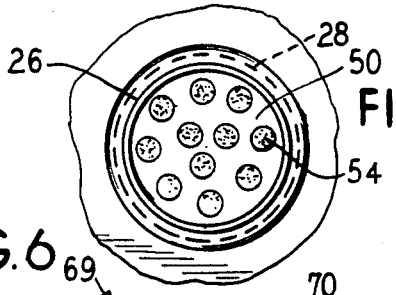
FIG. 4 is a plan view of an alternate cover as can be applied to the cartridge of FIG. 1.

FIG. 4 shows a cover 50 which can be mounted on top of the opening 27 to act as a guard against touching the ink roller 28 and smudging fingers and effectively retains the ink roller in position especially when handling the cartridge. The cover 50 provides a plurality of apertures 54 for dropping the ink therethrough onto the ink roller 28 in a dispersed manner to quickly and evenly add ink throughout the ink roller 28.

Figure 5:
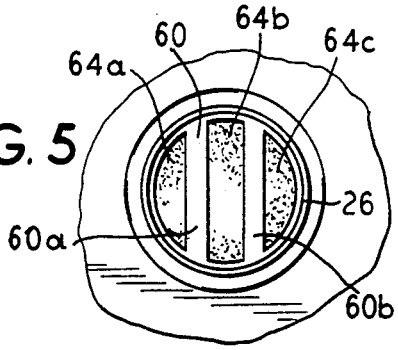
FIG. 5 is a plan view of another alternate cover to the cartridge of FIG. 1.

FIG. 5 shows an alternate cover 60 to the cover 50 as shown in FIG. 4. This alternate cover 60 provides two slats **60*a*, 60*b* which divide the cover 60 into three openings 64*a*, 64*b*, 64*c* for dispensing the ink therethrough. The slats 60*a*, 60*b* prevent fingers from touching the ink roller 28**.

Figure 6:
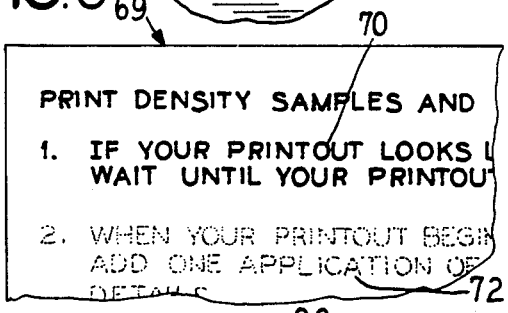
FIG. 6 is a graphical printing guide or key for testing printing output.

FIG. 6 shows a printing guide or key 69 which provides to a user a simple easily comprehended guide to determining the ink quantity status of the cartridge 10. If the printer output resembles the dark print at 70 the ink level in the cartridge 10 is adequate. However, if the print output resembles the fainter print at 72 then the instruction is communicated to add a measured amount of ink to the ink roller 28. The instruction for adding ink is in fact incorporated into the fainter print at 72.

Figure 7:
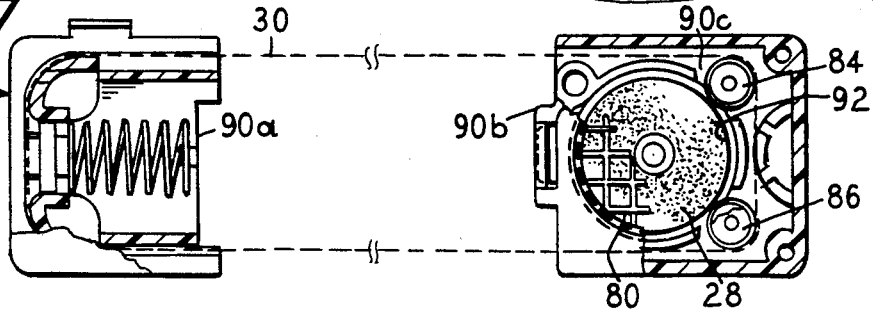
FIG. 7 is an alternate embodiment of a printer cartridge.

FIG. 7 shows an alternate embodiment 78 of the cartridge 10 which generally corresponds to a commercial cartridge, Drucker, Riteman f+/c+ but modified by the present invention. Two counter wheels 84, 86 are provided which remove ink from the ink roller 28 and deposits the ink onto the ribbon 30. The cartridge 78 is split into two casings, a first casing **90*a* and a second casing 90*b*. The second casing 90*b* holds the ink roller 28. According to the present invention, an opening 92 arranged in a cover 90*c* of the second is aligned above the ink roller 28. A cage 80 is provided covering the opening 92 to prevent finger smudging by contact with the ink roller 28. The ink 49*a* can be dropped through the cage 80 onto the ink roller 28**.

Figure 8:
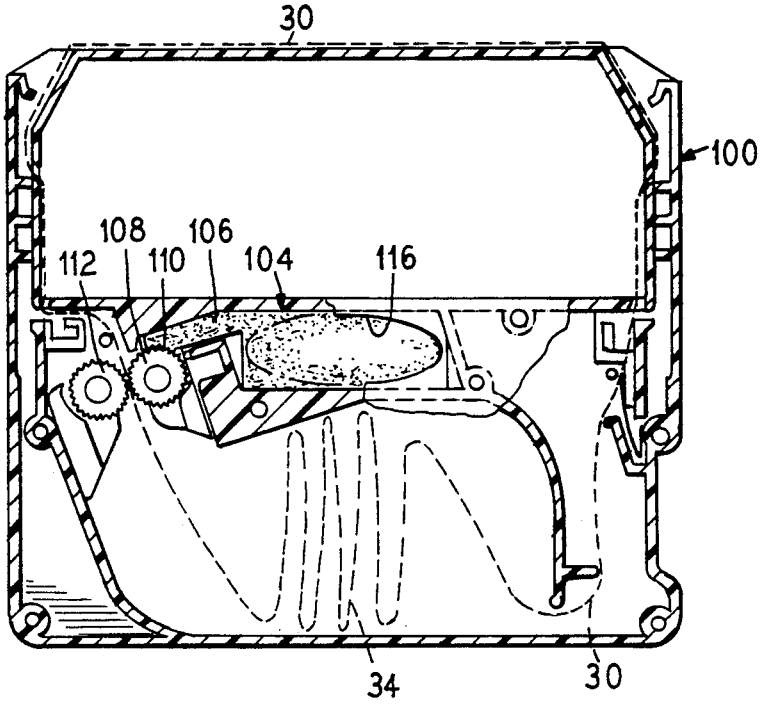
FIG. 8 is a second alternate embodiment of a printer cartridge.

FIG. 8 is a second alternate embodiment 100 of the cartridge 10. This embodiment is generally that of Injection Point Technology, Inc.'s version of the NCR 2140 cartridge but modified by the present invention. An idler gear 108 makes contact with an ink retaining mass 104 at a contact point 110. The ink retaining mass 104 is an absorbent material which holds ink therein. The ink retaining mass 104 is generally rectangularly shaped with a protruding branch 106. The ink is transferred from the ink retaining mass 104 along the branch 106 by capillary action to make contact at the contact point 110 with the idler gear 108. The idler gear 108 transfers ink onto the ribbon 30, which is pinched between a drive gear 112 and the idler gear 108. This ink retaining mass 104, according to the Applicant's present invention, can be communicated with through an oblong opening 116 through a top cover of the cartridge 100.

Figure 9:
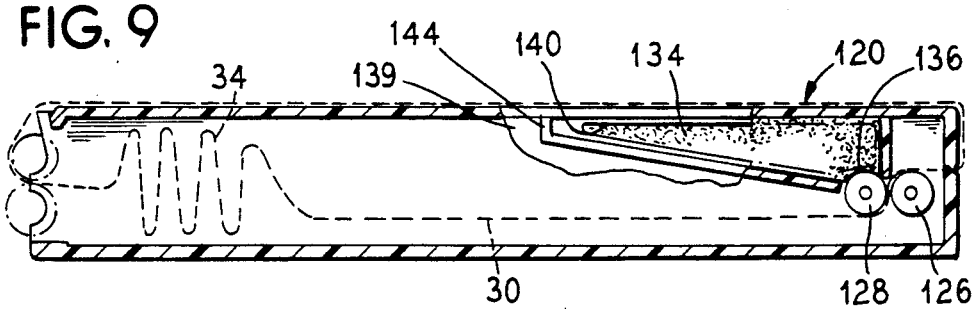
FIG. 9 is a third alternate embodiment of a printer cartridge.

FIG. 9 shows a third alternate embodiment cartridge 120 wherein the cartridge corresponds to a modified IBM System 32 Model B Harmonica Fabric cartridge. Applicant has added an ink applying roller 128 communicating closely with a second roller 126 which pinch the ribbon 30 therebetween. The ink applying roller 128 makes contact at a contact point 136 with an ink reservoir 134 which is an ink absorbent material. The ink applying roller 128 therefore would remove ink from the reservoir 134 and place the ink onto the ribbon 30. Through a cover 139, shown partially in FIG. 9, an opening 140 is provided aligned above the reservoir 134, for adding ink thereon. A lip 144 can be utilized around the opening 140 to facilitate adding a cover and to prevent finger smudging. The reservoir 134 can be shaped triangularly as shown in the figure.

Figure 10:
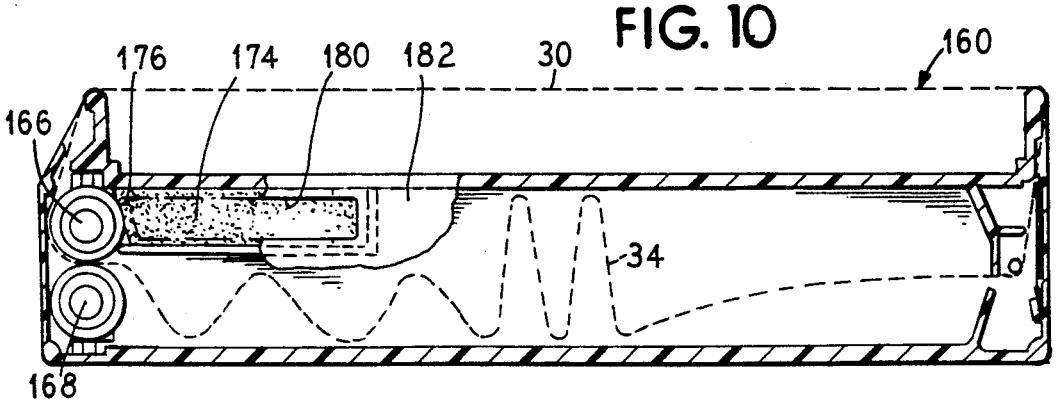
FIG. 10 is a fourth alternate embodiment of a printer cartridge.

FIG. 10 shows a fourth alternate embodiment 160 of the cartridge which corresponds to a cartridge such as a modified Shinwa SP 80 or a modified IBM 4214. According to the invention, applicant adds an ink reservoir 174 which makes contact at a contact point 176 with an inking roller 166 which pinches the ribbon 30 against a drive roller 168. The inking roller 166 removes ink from the reservoir 174 and places the ink onto the ribbon 30. The reservoir 174 is rectangularly shaped and can comprise a sponge-like ink absorbent material. A portion of a top cover 182 is shown with a rectangular opening 180 aligned above the reservoir 174 for dropping ink therethrough to replenish the reservoir 174.

Figure 11:
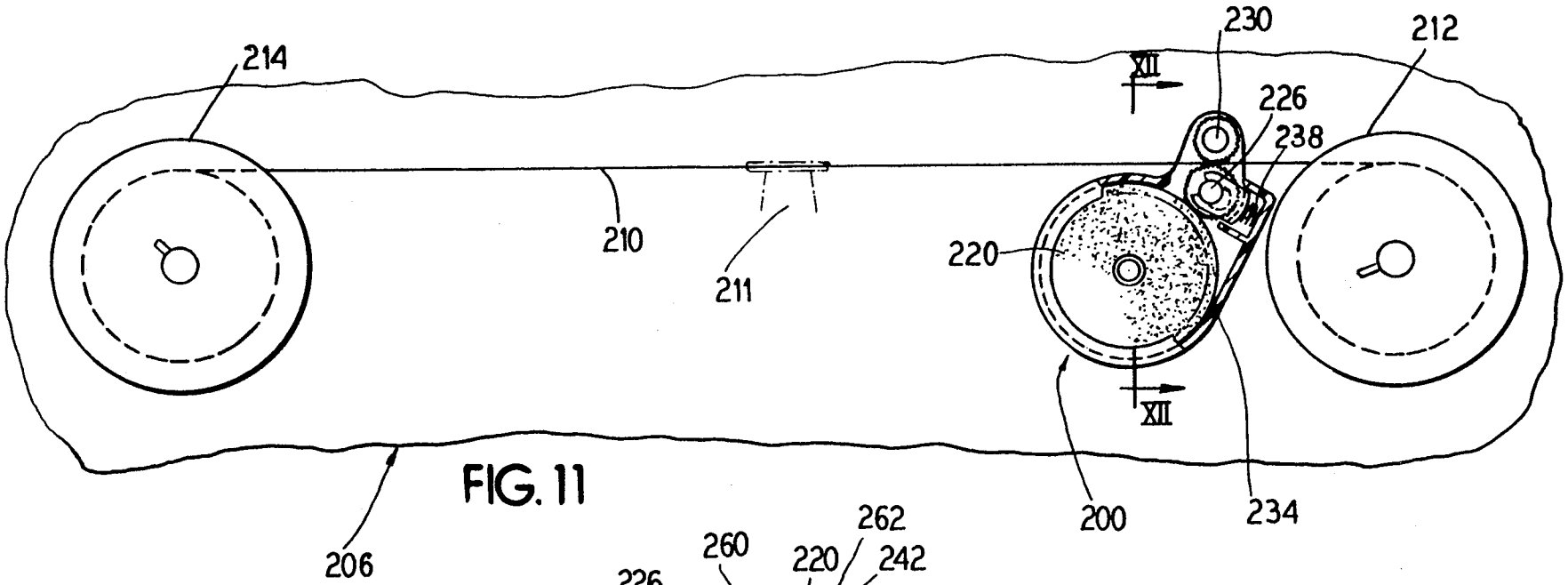
FIG. 11 is a partial plan view of a printer and a re-inking arrangement, in fragmentary view, for use with a spooled ribbon.

As clear from the aforementioned apparatus description the invention provides an efficient means to re-ink a cartridge. As shown in FIG. 11 a re-inking apparatus 200 can be applied to a printer 206 having a spooled ribbon rather than a cartridge. As shown in FIG. 11, the printer 206 has a spooled ribbon 210 in printing communication with a printer head 211. The spooled ribbon 210 is wound around and carried by two spools, a first spool 212 and a second spool 214. The ribbon progresses in use from one of the spools 212, 214 to the respective other spool 212, 214 as is known. The re-inking apparatus 200 provides an ink retaining mass 220 for holding a supply of ink therein, such as described above with respect to the cartridge ink retaining masses or ink retaining reservoirs. The ink retaining mass 200 comprises an absorbent material for holding the ink therein. The re-inking apparatus 200 also provides a drive roller 226 in rolling abutment with the retaining mass 220 and an idle roller 230. The ribbon 210 is pinched between the drive roller 226 and the idle roller 230. The drive roller 226 removes ink from the retaining mass 220 and deposits the ink onto the ribbon 210 as the ribbon 210 progresses past the drive roller 226, and the drive roller 226 rolls against the retaining mass 220. Surrounding the re-inking apparatus 200 is a frame 234 which rotatably mounts the retaining mass 220, rotatably mounts the drive roller 226, and rotatably mounts the idle roller 230. The drive roller 226 is spring biased off the frame 234 with a spring 238 so that the drive roller 226 resiliently presses against the retaining mass 220 and presses the ribbon 210 against the idle roller 230.

Figure 12:
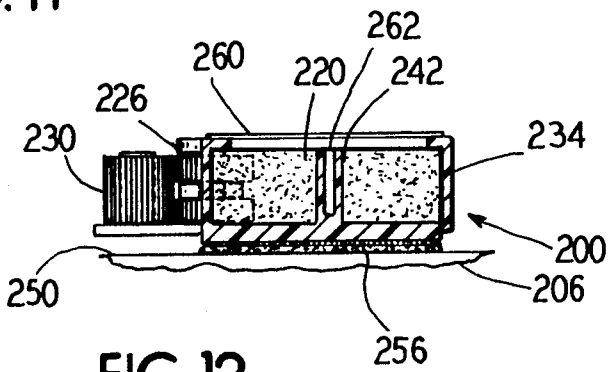
FIG. 12 is a section view taken generally along line XII—XII of FIG. 11.

FIG. 12 shows in section the re-inking apparatus 200 with the retaining mass 220 as a cylindrically shaped roller rotatably mounted to a spindle 242. The re-inking apparatus 200 is shown mounted to a top surface 250 of the printer 206 by the convenient use of an adhesive arrangement 256. The adhesive arrangement 256 can comprise glue, self-sticking tape or two-sided tape, mechanical surface fasteners such as VELCRO brand strips with adhesive on outer surfaces to bond to the re-inking apparatus 200 and the top surface 250 respectively, or any other known means to fasten the re-inking apparatus 200 to the printer 206. Clamps, screws, or mechanical fasteners are also encompassed by the invention. Also shown in FIG. 12 is a cover 260 which can completely cover an exposed surface 262 of the retaining mass 220 to prevent contact from a user's finger, and which can be removed to resupply the retaining mass 220 with ink according to the invention. It should be noted that this removable cover 260 can also be incorporated in all of the embodiments of the ink pad or roller of the present invention including all of the cartridge applications. Additionally, the various apertured covers described hereinabove for the cartridges can be used with the embodiment of FIG. 12 for dropping ink therethrough.

With regard to the Okidata type cartridge 10 of FIG. 1, the following method will provide consistent, intense printout throughout the life of the ribbon 30. Generally, the user should add ink to the ink roller 28 every 200–300 pages of average printout Enough ink should be added to cover the top surface **28*a* of the ink roller 28**, which would be approximately 10–12 drops of ink.

The invention in any of the above described embodiments, provides an improved method of maintaining a proper amount of ink in a printer ribbon. The primary causes of variations in re-inking frequency, in the present invention "re-inking" being the addition of ink to the ink pad, are:

(a) amount of printout per page,
(b) type of paper being used,
(c) impact setting on printer.

The refilling method of the present invention, however, is very flexible and almost foolproof as long as the user applies common sense.

A rule of thumb for the method is, when the printout begins to noticeably become lighter, the user is instructed to add about 10 drops of ink, to cover the surface **28*a* of the ink roller 28. The user is instructed to not wait until his printout becomes very light. At that point, two or three applications of ink may be required to bring the ribbon 30** back to maximum printing darkness or intensity.

As part of the invention the guide 69 provides a foolproof method to maintain the ink roller 28 at sufficient capacity with ink. If current in-use printer output resembles the printing at 70, no ink should be added. If, however, the printer output resembles the printing at 72 or lighter, the user is instructed to add 10–12 drops of ink. The printer output should return to the intensity as displayed in the printing at 70 within the next 20–30 pages of printout or sooner. If after that time the printing intensity does not return to the intensity of the printing at 70 the user is instructed to add another 5–6 drops of ink to the printing roller 28.

If the user has used the printer to a point where the printing is significantly lighter than that shown at printing 72 it may take 2 or more applications of ink before the ribbon 30 returns to the intensity of the printing at 70. The method of applying the ink is as follows:

1. Add 10–12 drops of ink to the ink roller 28.
2. Run a printout.
3. Add between 5–6 drops of ink to the ink roller repeatedly, running a printout between each application, until the user sees that the printout has returned to the intensity of the printing at 70.

The user is cautioned against overapplying ink to the ink roller 28 and cautioned that it takes some time for the ink to be absorbed by the ink roller 28.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. An apparatus for re-inking a ribbon for a printer comprising:

a housing having a top wall, said housing mounted to said printer;

an ink pad residing inside said housing, beneath said top wall, said ink pad having a top surface area, said ink pad for holding a capacity of ink;

roller means for continuously removing an amount of ink from said ink pad and applying said amount of ink onto said ribbon;

said housing provides at least one opening through said top wall, arranged above said top surface area, said at least one opening comprising an aggregate open area at least 50% of said top surface area of said ink pad, said at least one opening for applying incremental amounts of ink therethrough, onto said ink pad to replenish the pad.

2. An apparatus according to claim 1, wherein said at least one opening is surrounded by a lip on an outside of said housing.

3. An apparatus according to claim 1, wherein said ink pad comprises an ink roller mounted for rotating movement with respect to said housing; and said roller means further comprises an ink applying roller, a circumference of said ink applying roller in contact with said ink roller, and in contact with said ribbon, said ink applying roller removing amounts of ink from said ink roller and applying those amounts to said ribbon, said ink roller rotating with its circumference rolling in contact with a rolling circumference of said ink applying roller.

4. An apparatus according to claim 1 further comprising a cover, said cover overlying said at least one opening, said cover providing at least one aperture for dropping drops of ink therethrough onto said ink pad, said cover providing a barrier to prevent a person's finger from touching said ink pad.

5. An apparatus according to claim 1 further comprising a removable cover, said cover overlying said at least one opening, said removable for dropping drops of ink into said opening.

6. An apparatus according to claim 1 further comprising:

a piece of paper;

a first sample of printing on said paper having a first printing weight corresponding to a desired ink capacity of said ink pad; and a second sample of readable printing on said paper, adjacent to said first sample of printing, having a second printing weight more faint than said first sample and corresponding to an ink level in said ink pad wherein a select additional amount of ink is required to replenish said ink pad to said desired ink capacity.

7. An apparatus according to claim 1, wherein said at least one opening is opened to substantially all of said top surface area of said ink pad.

8. An apparatus according to claim 1 wherein said ink pad comprises:

an ink roller mounted for a rotation about a vertical axis, beneath said top wall; and wherein said at least one opening comprises a circular opening, said circular opening coaxially aligned with said vertical axis of said ink roller.

9. An apparatus according to claim 8, wherein said circular opening exposes substantially all of said top surface area of said ink roller.

10. An apparatus for re-inking a ribbon for a printer, comprising:

a housing having a top wall, said housing mounted to said printer;

an ink pad residing inside said housing, beneath said top wall, said ink pad having a top surface area, said ink pad for holding a capacity of ink;

roller means for continuously removing an amount of ink from said ink pad and applying said amount of ink onto said ribbon;

said housing provides at least one opening through said top wall, arranged above said top surface area, said at least one opening comprising an open area at least 20% of said top surface area of said ink pad, said at least one opening for applying incremental amounts of ink therethrough, onto said ink pad to replenish the pad;

a piece of paper;

a first sample of printing on said paper having a first printing weight corresponding to a desired ink capacity of said ink pad;

a second sample of readable printing on said paper, adjacent to said first sample of printing, having a second printing weight more faint than said first sample and corresponding to an ink level in said ink pad wherein a select additional amount of ink is required to replenish said ink pad to said desired ink capacity;

wherein said second sample of printing comprises letters selected to form alpha numeric printed indica giving readable instructions to the user as to the amount of ink to be added to the ink pad to replenish the ink pad to said desired ink capacity.

11. An apparatus for re-inking a ribbon for a printer, comprising:

a housing having a top wall, said housing mounted to said printer;

an ink pad residing inside said housing, beneath said top wall, said ink pad having a top surface area, said ink pad for holding a capacity of ink;

roller means for continuously removing an amount of ink from said ink pad and applying said amount of ink onto said ribbon;

said housing provides at least one opening through said top wall, arranged above said top surface area, said at least one opening comprising an open area at least 20% of said top surface area of said ink pad, said at least one opening for applying incremental amounts of ink therethrough, onto said ink pad to replenish the pad;

a piece of paper;

a first sample of printing on said paper having a first printing weight corresponding to a desired ink capacity of said ink pad; and a second sample of readable printing on said paper, adjacent to said first sample of printing, having a second printing weight more faint than said first sample and corresponding to an ink level in said ink pad wherein a select additional amount of ink is required to replenish said ink pad to said desired ink capacity;

wherein said second sample of printing comprises letters selected to form alpha numeric printed indica giving readable instructions to the user as to the amount of ink to be added to the ink pad to replenish the ink pad to said desired ink capacity; and wherein said second printing weight is selected to correspond to an ink pad ink capacity requiring addition of 10–12 drops of ink to be added to said ink pad to replenish said ink pad to said desired ink capacity.

12. A method for replenishing ink content in a ribbon cartridge for a printer comprising the following steps:

providing a cartridge having a ribbon carried therein;

providing an ink pad located within said cartridge and holding a capacity of ink, said ink pad having a top surface area;

providing a roller means for removing desired quantities of ink from said ink pad and applying said quantities onto said ribbon during use;

providing at least one opening in said cartridge, said at least one opening arranged overlying said ink pad exposing at least 20% of said top surface area of said ink pad, so that measured quantities of ink may be distributed onto the ink pad from an outside source of ink;

using the cartridge in the printer, printing a printing output;

providing a printing guide which displays two printing samples, a first sample corresponding to a printer output wherein a sufficient quantity of ink exists in a hypothetical cartridge, and a second sample of a fainter print corresponding to a cartridge which needs replenishing with ink;

comparing the printing output to the first sample and the second sample; and if the printing output resembles said second sample of said printing guide adding 10–12 drops of ink to said ink pad through said at least one opening in the cartridge onto said ink pad.

13. A method for replenishing ink content in a ribbon cartridge for a printer comprising the following steps:

providing a cartridge having a top wall and having a ribbon carried therein;

providing an ink pad located within said cartridge and holding a capacity of ink, said ink pad having a top surface area;

providing a roller means for removing desired quantities of ink from said ink pad and applying said quantities onto said ribbon during use;

providing at least one opening in said cartridge, said at least one opening arranged directly exposing through said top wall at least 50% in aggregate of said top surface area of said ink pad, so that measured quantities of ink may be distributed onto the ink pad from an outside source of ink;

dropping a measured amount of ink through said at least one opening, onto said pad.

14. A method for replenishing ink content in a ribbon cartridge for a printer comprising the following steps:

providing a cartridge having a top wall and having a ribbon carried therein;

providing an ink pad located within said cartridge and holding a capacity of ink, said ink pad having a top surface area;

providing a roller means for removing desired quantities of ink from said ink pad and applying said quantities onto said ribbon during use;

providing at least one opening in said cartridge, said at least one opening arranged exposing substantially all of the top at least 20% of said top surface area of said ink pad, so that measured quantities of ink may be distributed onto the ink pad from an outside source of ink;

dropping a measured amount of ink through said at least one opening, onto said pad.

15. An improved printer cartridge holding a ribbon for a printer, comprising:

a housing having a top wall;

an ink pad residing inside said housing, for holding a capacity of ink, said ink pad having a top surface area;

a roller means for continuously removing an amount of ink from said ink pad and applying said amount of ink onto said ribbon;

said housing provides at least one opening through said top wall located overlying said ink pad and exposing at least 20% of said top surface area of said ink pad, said at least one opening for applying incremental amounts of ink therethrough, onto said ink pad to replenish the pad; and additional openings through said top wall, all openings exposing in aggregate at least 50% of said top surface area.

16. A cartridge according to claim 15, wherein said at least one opening is surrounded by a lip on an outside of said housing.

17. A cartridge according to claim 15, wherein said ink pad comprises an ink roller mounted for rotating movement with respect to said housing; and said roller means comprises an ink applying roller, a circumference of said ink applying roller in contact with said ink roller, and in contact with said ribbon, said ink applying roller removing amounts of ink from said ink roller and applying those amounts to said ribbon, said ink roller rotating with its circumference rolling in contact with a rolling circumference of said ink applying roller.

18. A cartridge according to claim 15 further comprising a cover, said cover overlying said at least one opening, said cover providing at least one aperture for dropping drops of ink therethrough onto said ink pad, said cover providing a barrier to prevent a person's finger from touching said ink pad.

19. An improved printer cartridge holding a ribbon for a printer, comprising:

a housing having a top wall;

an ink pad residing inside said housing, for holding a capacity of ink, said ink pad having a top surface area;

a roller means for continuously removing an amount of ink from said ink pad and applying said amount of ink onto said ribbon;

said housing provides at least one opening through said top wall located overlying said ink pad and exposing at least 20% of said top surface area of said ink pad, said at least one opening for applying incremental amounts of ink therethrough, onto said ink pad to replenish the pad; and said at least one opening is located overlying said ink pad and exposing substantially all of said top surface area.

20. A cartridge according to claim 19 further comprising a cover, said cover overlying said at least one opening, said cover fashioned removable for dropping drops of ink through said at least one opening, said cover providing a barrier to prevent a person's finger from touching said ink pad.

21. A method for replenishing ink content in a ribbon cartridge for a printer comprising the following steps:

providing a cartridge having a ribbon carried therein;

providing an ink pad located within said cartridge and holding a capacity of ink, said ink pad having a top surface area;

providing a roller means for removing desired quantities of ink from said ink pad and applying said quantities onto said ribbon during use;

providing at least one opening in said cartridge, said at least one opening arranged overlying said ink pad exposing at least 20% of said top surface area of said ink pad, so that measured quantities of ink may be distributed onto the ink pad from an outside source of ink;

using the cartridge in the printer, printing a printing output;

providing a printing guide which displays two printing samples, a first sample corresponding to a printer output wherein a sufficient quantity of ink exists in a hypothetical cartridge, and a second sample of a fainter print corresponding to a cartridge which needs replenishing with ink;

comparing the printing output to the first sample and the second sample; and if the printing output resembles said second sample of said printing guide adding selective amounts of ink to said ink pad through said at least one opening in the cartridge onto said ink pad.

* * * * *

UNITED STATES PATENT AND TRADEMARK OFFICE

CERTIFICATE OF CORRECTION

PATENT NO. : 5,207,519

DATED : May 4, 1993

INVENTOR(S) : Frank M. Debreczenyi

It is certified that error appears in the above-indentified patent and that said Letters Patent is hereby corrected as shown below:

Column 5, line 35, replace "color" with --color)--.
Column 7, line 61, insert --,the-- between "invention" and "cartridge".
Column 8, line 23, replace "a" with --an--.
Column 10, line 39, insert --.-- between "printout" and "Enough".
Column 14, line 24, claim 14, delete "at least 20% of said top".

Signed and Sealed this

Twenty-first Day of June, 1994

Bruce Lehman

*Attest:*

BRUCE LEHMAN

*Attesting Officer*

*Commissioner of Patents and Trademarks*